United States Patent [19]

Council

[11] 4,176,033

[45] Nov. 27, 1979

[54] ANODE CLAMP ASSEMBLY AND METHOD OF INSTALLATION

[75] Inventor: James M. Council, Slidell, La.

[73] Assignee: Exxon Production Research Company, Houston, Tex.

[21] Appl. No.: 895,212

[22] Filed: Apr. 10, 1978

[51] Int. Cl.[2] ..... C23F 13/00

[52] U.S. Cl. ..... 204/197; 204/148; 204/286

[58] Field of Search ..... 204/148, 197

[56] References Cited

U.S. PATENT DOCUMENTS

| | | | |
|---|---|---|---|
| 3,553,094 | 1/1971 | Scott et al. | 204/148 |
| 3,623,968 | 11/1971 | Bohne | 204/148 |
| 3,803,012 | 4/1974 | Kurr | 204/197 |

*Primary Examiner*—Howard S. Williams
*Attorney, Agent, or Firm*—John S. Schneider

[57] ABSTRACT

An anode clamp assembly for use in protecting metallic support structure for an offshore oil and/or gas well operations platform from galvanic corrosion is disclosed. The assembly comprises a U-shaped metallic channeled member having straight sides and means for connecting the free ends of two sides of the U-shaped member to each other to clamp the member on the support structure of the offshore platform to be protected and at least one metallic anode spaced from and connected to the channeled member. The anode clamp assembly is transported to the support structure to be protected and then clamped to that support structure by divers. Electrical contact between the channeled member and the support structure is then assured by welding the channeled member to the support structure and/or by means of a set screw connecting the channeled member to the metal of the support structure.

20 Claims, 6 Drawing Figures

FIG. 1.
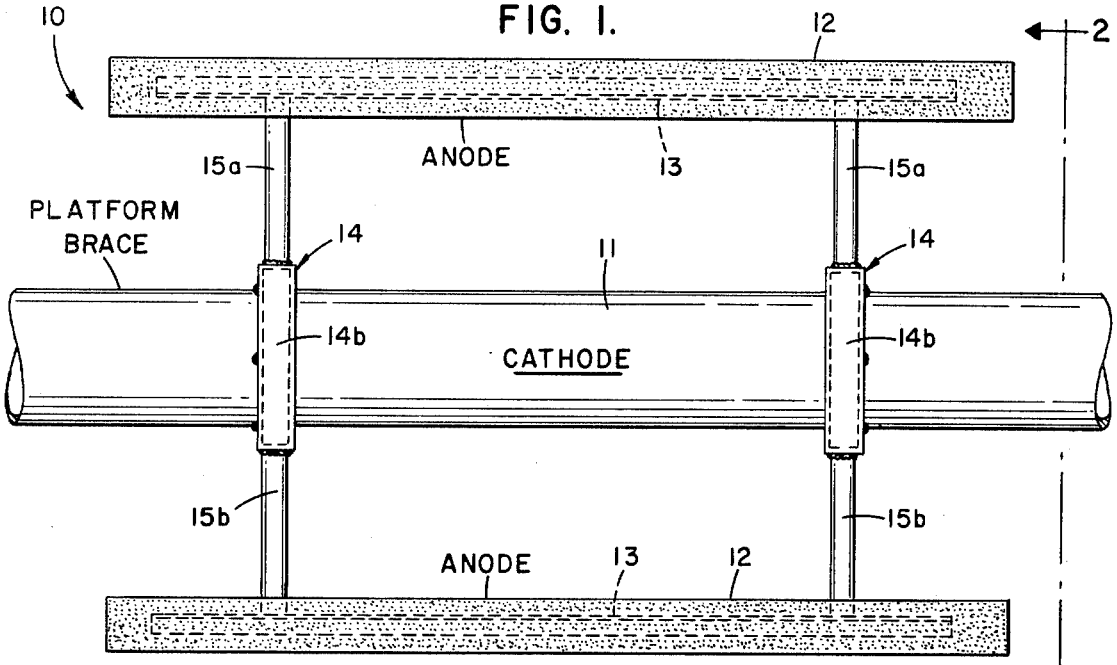
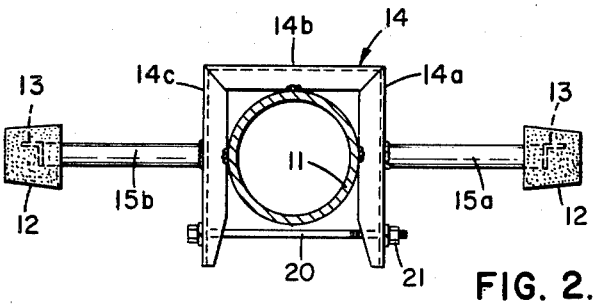
FIG. 2.
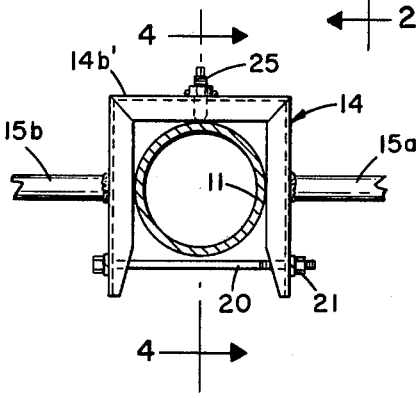
FIG. 3.
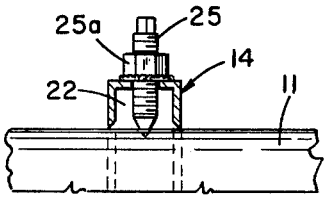
FIG. 4.
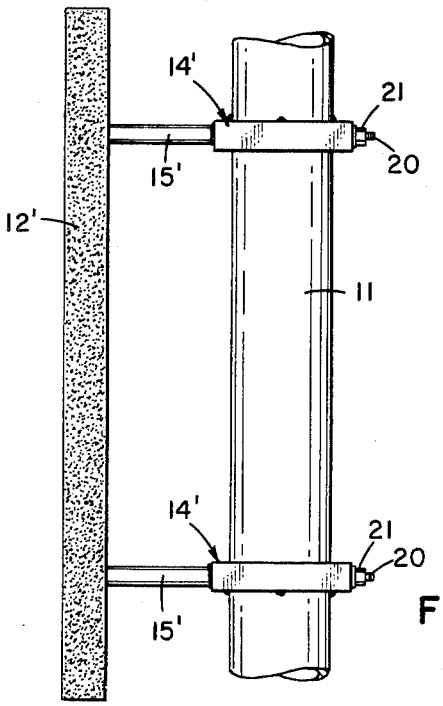
FIG. 6.
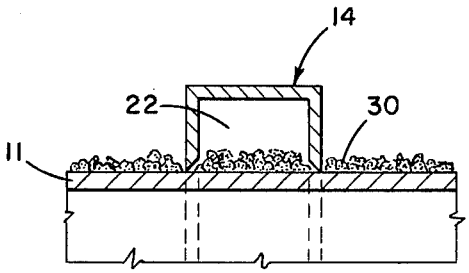
FIG. 5.

ANODE CLAMP ASSEMBLY AND METHOD OF INSTALLATION

BACKGROUND OF THE INVENTION

The present invention concerns an anode clamp assembly which when installed provides cathodic protection to offshore platform support structure, such as braces, used on offshore oil and/or gas well drilling operations. One cathodic protection type clamp currently being used is a two-piece, four-bolt riser type clamp that requires thorough removal of marine growths in the area where the clamp is to be installed. The clamp of the present invention is a one-piece clamp which is simple to fabricate and is designed to be installed without cleaning the area of installation. In addition to saving the time required by divers to remove barnacle and other marine growth only one bolt, instead of four, expedites clamp tightening.

SUMMARY OF THE INVENTION

An anode clamp assembly comprising a metallic U-shaped channeled member having straight sides; means connecting the free ends of said channeled member to each other for clamping said channeled member onto structure to be cathodically protected; a metallic anode spaced from said channeled member; and means connecting said anode to said channeled member, said anode being in electrical contact with said channeled member when installed on said structure, said channeled member being in electrical contact with said structure. Divers clamp the channeled member to the structure and then tack weld the channeled member to the structure and/or connect the structure electrically to the channeled member by means of a set screw.

BRIEF DESCRIPTION OF THE DRAWINGS

FIG. 1 is a plan view of the anode clamp assembly of the invention connected to an offshore platform brace;

FIG. 2 is a view taken along lines 2—2 of FIG. 1;

FIG. 3 is a view similar to that of FIG. 2 illustrating a modification of the anode clamp assembly installation;

FIG. 4 is an enlarged view of the set screw-channel taken along lines 4—4 of FIG. 3;

FIG. 5 is an enlarged view of the channel of FIG. 4 showing, also, marine growth on the pipe brace member; and FIG. 6 is a vertical view of a modified anode clamp assembly installed on an offshore platform brace.

DESCRIPTION OF THE PREFERRED EMBODIMENTS

There is shown in FIGS. 1 and 2 an anode clamp assembly, generally designated 10, secured or clamped to a steel brace or pipe member 11 which is part of the support or sub-structure for an offshore platform used for oil and/or gas well drilling or production operations. The anode clamp assembly provides cathodic protection for the structural members of the submerged platform; that is, an impressed current prevents or reduces the rate of corrosion of such members in water by making them the cathode for the impressed current. Extending longitudinally along and on each side of member 11 are metal anodes 12 as shown in FIG. 2, an angle iron or pipe core 13 may be embedded in each anode 12. The anodes are cast around the angle irons or pipe cores 13 to which metal struts or arms 15*a* and 15*b* are either welded or made integral. This provides a rigid core for the soft metal anode, a method of attachment, and electrical contact for all areas even after portions of the anode metal have dissolved or otherwise spent themselves in salt water. A U-shaped member 14, having three straight sides 14*a*, 14*b* and 14*c* welded to each other at their ends, is connected to anodes 12 by welding to arms 15*a* and 15*b* with all parts of the assembly properly aligned as shown. The free ends of sides 14*a* and 14*c* of U-shaped member 14 are connected to each other by a stud or bolt 20 to which is threaded a nut 21 for use in clamping U-shaped member on member 11. As seen more clearly in FIG. 4 U-shaped member 14 is fabricated from standard structural steel channels, forming channel 22, to provide strength for the U-shaped member and to accommodate marine growth. The channel size is determined by structural strength requirements and depth of the channel is selected to be greater than the thickness of marine growth in each area. When the member 11 is iron or steel the anode is preferably aluminum but may be magnesium or zinc or alloys thereof.

When installing clamp assembly 10 on member 11 divers set the U-shaped members 14 on member 11 and then insert bolt 20 through the ends of sides 14*a* and 14*c* and tighten nut 21 to clamp U-shaped member 14 on member 11. At least one contact point of each side 14*a*, 14*b* and 14*c* of U-shaped member 14 is then tack welded to member 11 at the center lines of the pipe member to enhance electrical grounding and clamp stability. Clamp nut 21 is also tack welded to the bolt or stud 20. Lock washers may be used at either or both ends of the bolt.

As shown in FIG. 3 the tack welding labor may be eliminated by installing a set screw 25 through upper side or shelf 14*b*′ to provide electrical contact between U-shaped member 14 and pipe member 11. Welding at the center lines of the pipe member provides a balanced assembly where the anode weight will assist clamp make-up and provide good contact for tack welding when the assembly is installed in the horizontal position.

Set screw 25, shown in more detail in FIG. 4, includes a nut 25*a* for forcing the screw into contact with member 11. The edges of the U-shaped channels 14 are tapered, as also shown in FIG. 5, to facilitate cutting through and penetrating marine growth, indicated at 30, at the top and side contact points with platform member 11.

The anode clamp assembly can also be installed in the vertical position and may be designed for a single anode connected to one side of the brace pipe as shown in FIG. 6. There an anode 12′ is connected to member 11 by U-shaped members 14′ connected to anode 12′ by struts 15′. The single anode assemblies can also be used in the horizontal position if needed, to obtain proper anode placement and distribution of anodes.

Other than standard size channels 21 may be used. Also, this U-shaped design can be sized to fit any diameter platform member and can be fabricated by any welding shop. Other type cathodic protection designs require special tools for shaping the plate to form each side of the clamp. Such a clamp blocks the cathodic protection current from areas under the clamp. The channel and standoff of this invention will eliminate that shielding problem.

Changes and modifications may be made in the illustrative embodiments of the invention shown and described herein without departing from the scope of the invention as defined in the appended claims.

Having fully described the nature, operation, advantages and objects of our invention we claim:

1. An anode clamp assembly for connection to a submerged cylindrical support member for an offshore platform comprising;

at least two U-shaped members each having three straight sides;

means for connecting the free ends of two of said sides of each U-shaped member to each other to clamp said U-shaped members to said support member, said sides of each of said U-shaped members contacting said support member at at least three spaced-apart points;

at least one metallic anode spaced from said U-shaped members and extending longitudinally of said support member;

a metallic core embedded in said anode and extending longitudinally therewith; and at least two laterally extending arms connecting said core to at least one side of each of said U-shaped members providing electrical contact between said anode and said U-shaped members, each of said U-shaped members extending over said support member to facilitate clamping said U-shaped members to said support member.

2. An assembly as recited in claim 1 in which said anode extends horizontally along the length of said support member.

3. An assembly as recited in claim 1 in which said anode extends vertically along the length of said support member.

4. An assembly as recited in claim 1 in which said anode comprises aluminum and said support member comprises steel.

5. An assembly as recited in claim 1 in which said anode comprises magnesium and said support member comprises steel.

6. As assembly as recited in claim 1 in which said anode comprises zinc and said support member comprises steel.

7. An assembly as recited in claim 1 in which said anode comprises an alloy of aluminum, magnesium and zinc and said support member comprises steel.

8. An assembly as recited in claim 1 in which each of said sides of each of said U-shaped members forms a channel, the size of said channel being selected to provide structural strength and the depth of the channel being selected to accommodate marine growth.

9. An assembly as recited in claim 8 in which each of said U-shaped members is deeper than it is wide.

10. An assembly as recited in claim 9 including a set screw connecting one of said sides of each of said U-shaped members and said support member to provide electrical contacts between said support member and said U-shaped members.

11. An assembly as recited in claim 8 in which the edges of said channels contacting said support member are tapered to facilitate cutting through and penetrating marine growth.

12. An assembly as claimed in claim 11 including set screws connecting at least one of said sides of said U-shaped members and said supporting member.

13. An assembly as recited in claim 12 including welds connecting said sides of said U-shaped members and said supporting member at said points of contact.

14. A method of installing an anode clamp assembly on a submerged support member of an offshore platform, said clamp assembly including at least two U-shaped members each having three straight sides, bolt means for clamping said U-shaped members to said support member, at least one anode spaced apart from said U-shaped members and extending longitudinally of said support member, a metallic core embedded in said anode and extending longitudinally thereof and laterally extending arms connecting at least one side of each of said U-shaped members to said core to provide electrical contact therebetween comprising the steps of:

placing said U-shaped members in position on said support member; and tighthening said bolt means to clamp said U-shaped members to said support member, said sides of each of said U-shaped members contacting said support member at at least three spaced-apart points said contact points enhancing electrical contact between said support member and said U-shaped members.

15. A method as recited in claim 14 including the step of welding said U-shaped members to said support member at said points of contact between said support member and said U-shaped member.

16. A method as recited in claim 14 including placing a set screw through one side of each of said U-shaped members to provide electrical contact between said support member and said U-shaped members.

17. A method as recited in claim 14 in which said anode comprises aluminum and said support member comprises steel.

18. A method as recited in claim 14 in which said anode comprises magnesium and said support member comprises steel.

19. A method as recited in claim 14 in which said anode comprises zinc and said support member comprises steel.

20. A method as recited in claim 14 in which said anode comprises an alloy of aluminum, magnesium and zinc and said support member comprises steel.

* * * * *